US008157114B2

(12) United States Patent
Baylous et al.

(10) Patent No.: US 8,157,114 B2
(45) Date of Patent: Apr. 17, 2012

(54) ADJUSTABLE CONTAINER

(76) Inventors: Vickie L. Baylous, Perrysburg, OH (US); Donald L. Baylous, Jr., Perrysburg, OH (US)

( * ) Notice: Subject to any disclaimer, the term of this patent is extended or adjusted under 35 U.S.C. 154(b) by 59 days.

(21) Appl. No.: 12/037,474

(22) Filed: Feb. 26, 2008

(65) Prior Publication Data

US 2008/0203048 A1 Aug. 28, 2008

Related U.S. Application Data

(60) Provisional application No. 60/903,670, filed on Feb. 26, 2007.

(51) Int. Cl.
*B65D 83/04* (2006.01)

(52) U.S. Cl. ..... 215/3; 220/719; 222/192; 222/386; 401/175; 401/54; D28/4

(58) Field of Classification Search ..... 215/3, 231; 220/626, 212, 228, 720; 222/192, 390
See application file for complete search history.

(56) References Cited

U.S. PATENT DOCUMENTS

| | | | | | |
|---|---|---|---|---|---|
| 2,123,731 | A * | 7/1938 | Kahn | 222/390 |
| 2,328,973 | A * | 9/1943 | Goldfisher | 401/11 |
| 2,335,049 | A * | 11/1943 | Finkelstein | 222/390 |
| 2,751,126 | A | 6/1956 | Chandler | |
| 2,845,707 | A * | 8/1958 | Redmond | 222/390 |
| 3,333,740 | A * | 8/1967 | Waller | 222/182 |
| 3,706,394 | A * | 12/1972 | Merz | 221/75 |
| 4,269,331 | A | 5/1981 | Watson | |
| 4,544,083 | A * | 10/1985 | Schroeder | 222/47 |
| 4,560,086 | A * | 12/1985 | Stol | 221/24 |
| 5,356,037 | A * | 10/1994 | Harrold | 222/95 |
| 5,421,663 | A * | 6/1995 | Bravo | 401/82 |
| 5,819,980 | A * | 10/1998 | Hill | 220/719 |
| 6,086,276 | A * | 7/2000 | Gueret | 401/54 |
| 6,722,530 | B1 | 4/2004 | King et al. | |
| 7,467,731 | B2 * | 12/2008 | Shraiber | 222/78 |
| 2003/0197028 | A1 * | 10/2003 | Jaekel | 222/192 |
| 2004/0069814 | A1 * | 4/2004 | Hemming et al. | 222/390 |
| 2005/0178796 | A1 * | 8/2005 | Shraiber | 222/78 |

* cited by examiner

*Primary Examiner* — Anthony Stashick

*Assistant Examiner* — Cynthia Collado

(74) *Attorney, Agent, or Firm* — Fraser Clemens Martin & Miller LLC; J. Douglas Miller

(57) ABSTRACT

An adjustable container is disclosed, wherein a plunger assembly disposed the container body cooperates with a support formed on an interior of the body to force the contents of the container upwardly towards a top thereof and to militate against the downward movement of said plunger assembly.

10 Claims, 2 Drawing Sheets

ADJUSTABLE CONTAINER

CROSS-REFERENCE TO RELATED APPLICATION

This application claims the benefit of Provisional Patent App. No. 60/903,670 filed Feb. 26, 2007.

FIELD OF THE INVENTION

The present invention relates to containers and, more particularly, to a container adapted to force the contents therein upwardly towards a top thereof to effect the removal of the contents therefrom.

BACKGROUND OF THE INVENTION

Packaging food items in containers has long been a convenient, and useful method of preserving perishable edibles. Canning was revolutionized in 1858 when John Landis Mason invented a practical glass jar and lid, commonly referred to as a Mason jar. Since then, many companies have used glass and plastic containers to store jams, vegetables, meats, condiments, and fruits.

The preferred method for preserving food products in containers is to vacuum seal or hot-pack the food in the container. In these processes, precooked, hot food and a portion of the liquid in which it was cooked are placed in a clean, hot jar. With the hot-pack method, the mouth of the jar is covered with a metal disk that includes a rubber ring seal. A screw-type lid is then partially screwed onto the finish of the glass jar. After the jar has been processed in boiling water for a desired amount of time, the screw top is tightened completely to create a fluid tight seal between the rubber ring seal of the metal disk and the jar. Heat and pressure during processing force most of the air from the jar, thereby minimizing the promulgation of disease-causing organisms within the jar. Supermarket shelves are laden with food items offered in glass or plastic containers adapted to preserve the freshness of the contents therein through vacuum sealing or the hot-pack method.

However, accessing the contents at the bottom of the container may be challenging and messy. As more processed foods are being offered in larger, economy size containers to appeal to families, accessing the contents at the bottom thereof has become exceedingly challenging and messy. Attempts to retrieve the food from the bottom of a container often result in a utensil handle and the hand of the user covered with food residue. Unable to easily retrieve the food from the bottom of the container, many users discard the container, thereby wasting any remaining food.

Despite the containers known in the art, there is a continuing need for an improved container adapted to force the contents of the container upwardly towards a top thereof and to effect the removal of the contents at the bottom thereof.

SUMMARY OF THE INVENTION

Accordingly, it is an objective of the present invention to produce an improved container adapted to force the contents of the container upwardly towards a top thereof and to effect the removal of the contents at the bottom thereof.

In a first embodiment, a container comprises a hollow body having a support formed on an inner wall thereof; and a plunger assembly disposed in said hollow body and adapted to adjustably to force the contents of the container upwardly towards a top thereof, wherein said plunger assembly and the support cooperate to militate against the downward movement of said plunger assembly.

In another embodiment, a container comprises a hollow body having a protuberance formed on an inner wall thereof; and a plunger assembly disposed in said hollow body and adapted to adjustably to force the contents of the container upwardly towards a top thereof, wherein said plunger assembly and the support cooperate to militate against the downward movement of said plunger assembly.

In another embodiment, A container comprises a hollow body having a channel formed in an inner wall thereof; and a plunger assembly disposed in said hollow body and adapted to adjustably to force the contents of the container upwardly towards a top thereof, wherein said plunger assembly and the support cooperate to militate against the downward movement of said plunger assembly.

BRIEF DESCRIPTION OF THE DRAWINGS

The above and other objects and advantages of the invention will become readily apparent to those skilled in the art from reading the following detailed description of the invention when considered in the light of the accompanying drawings, in which.

DETAILED DESCRIPTION OF THE EMBODIMENTS

The following detailed description and appended drawings describe and illustrate various exemplary embodiments of the invention. The description and drawings serve to enable one skilled in the art to make and use the invention, and are not intended to limit the scope of the invention in any manner.

Figure 1:
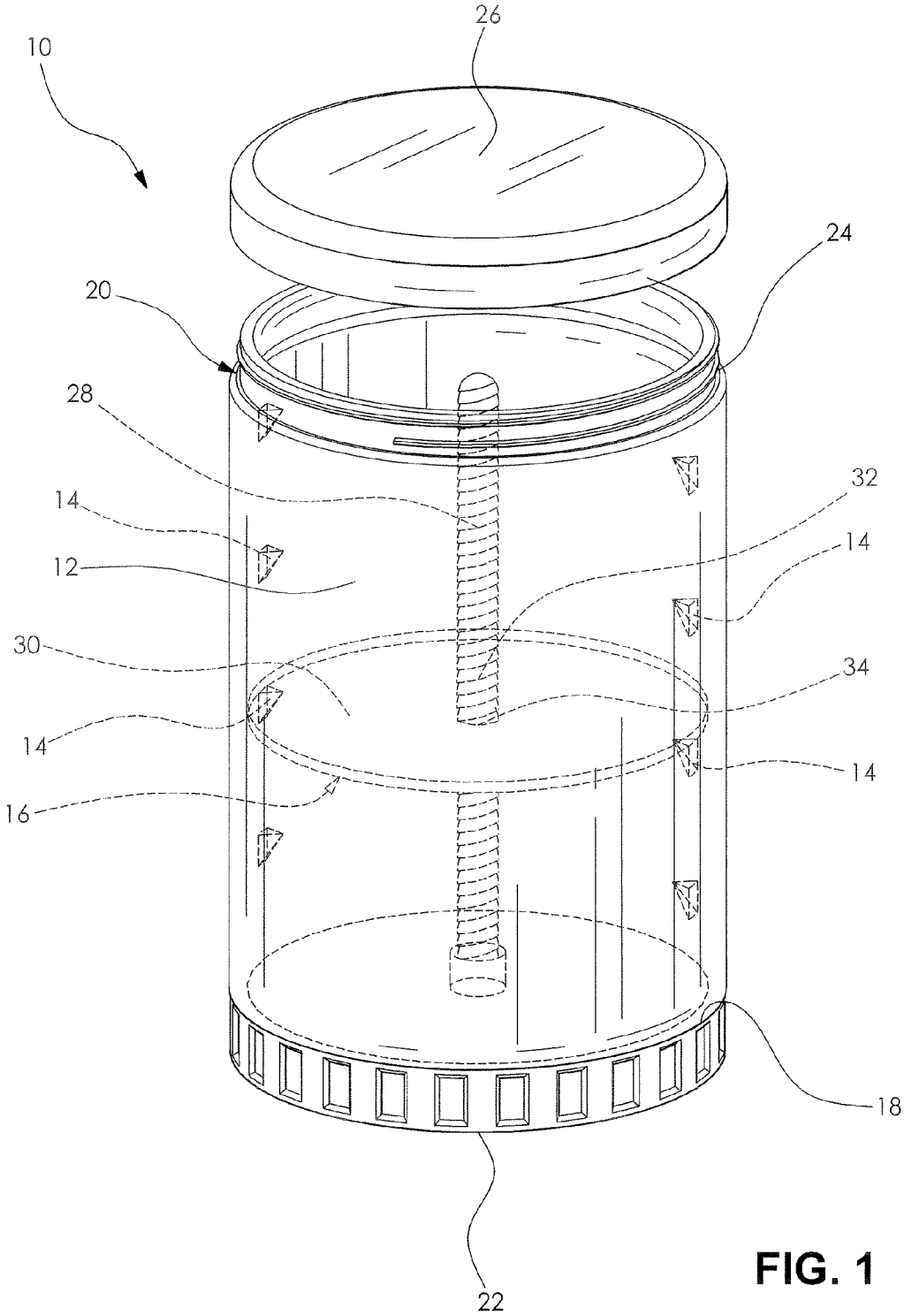
FIG. 1 is a perspective exploded view illustrating a container according to an embodiment of the invention.

FIG. 1 shows a container 10 according to an embodiment of the invention. The container 10 includes a hollow body 12, an internal support 14, and a plunger assembly 16. The container 10 is adapted to enclose food products and the like. However, the container 10 may hold any liquid, solid, suspension, colloid, or the like, as desired.

The body 12 of the container 10 includes a sidewall defining a hollow interior, an aperture 18 formed at a bottom thereof, and a finish 20. The aperture 18 is adapted to cooperate with a disc-shaped bottom support 22 of the plunger assembly 16. It is understood that the body 12 may have a bottom wall adjacent to the bottom support 22, as desired. The finish 20 is disposed at a top of the body 12 of the container 10. The finish 20 is hollow and communicates with the interior of the container 10 to receive fluid or food contents therethrough. The finish 20 includes a plurality of external threads 24. The threads 24 are adapted to cooperate with interim threads of a closure 26 to seal the interior of the container 10. The finish 20 may vary in size, shape, number of threads 24 to facilitate any closure. Further, the finish 20 may be a non-threaded finish adapted to receive a crown-type closure, a snap-fit closure, or the like. The closure 26 may be formed from a metal or a plastic, as desired. Additionally, the closure 26 or the finish 20 may include metal rings or rubber gaskets to form a fluid tight seal between the closure 26 and interior of the body 12.

The body 12 of the container 10 is substantially symmetric about an elongate axis but may be asymmetrical, as desired. The body 12 is typically formed from a polymer, such as polyethylene terephthalate or polypropylene, for example. It is understood that the container 10 may be formed from any polymer such as polyester, acrylonitrile acid esters, vinyl chloride, polyolefin, polyamide, and derivatives, blends, and copolymers thereof. The container 10 may also be formed from a glass or metal, as desired. The container 10 may be formed using any conventional process such as rotational molding, blow molding, reheat stretch blow molding, injection molding, casting, roll forming, stamping, and the like.

Figure 2:
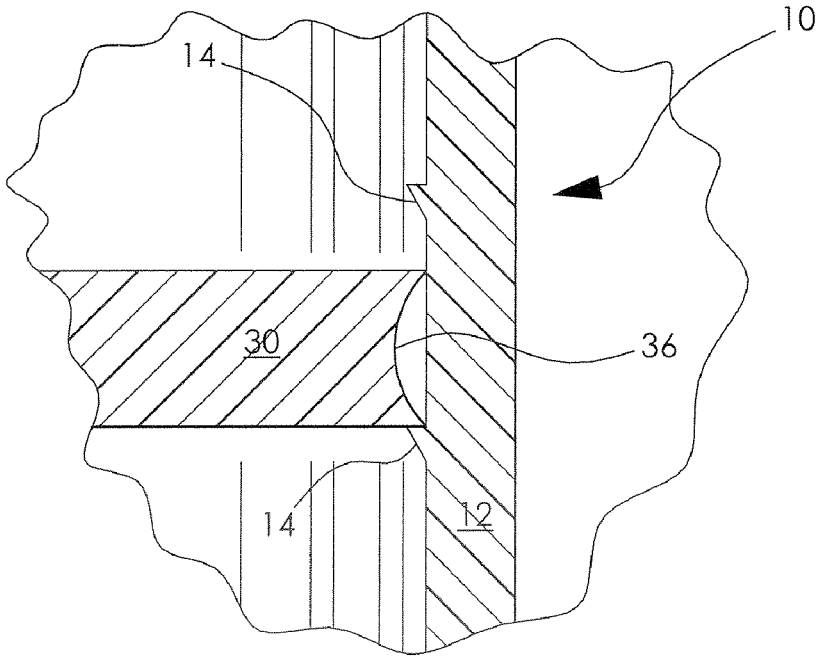
FIG. 2 is an enlarged fragmentary elevational view of a support of the container of FIG. 1.

In the embodiment shown in FIGS. 1-2, the support 14 is a plurality of spaced apart protuberances having a triangular cross-section. The protuberances are formed on an interior of the body 12 of the container 10 in an annular array. A plurality of annular arrays of protuberances is formed at desired heights on the interior of the body 12. Each array may include any number of protuberances, as desired. Any number supports 14 may be formed at any desired height on the interior of the body 12 of the container 10. It is understood that the protuberances may have any cross-sectional shape, such as rectilinear and curvilinear, as desired. It is also understood that the protuberances may be an annular shoulder formed on the interior of the body 12 of the container 10. Alternatively, the support 14 may be an annular channel formed in the body 12 of the container 10 or an array of channels formed therein.

The plunger assembly 16 includes the bottom support 22, an upstanding stem 28, also commonly referred to as a shank, and a plunger 30. The bottom support 22 is disposed adjacent to and covers the aperture 18 of the body 12 to seal the interior of the container 10. Additionally, the bottom support 22 or the bottom edge of the body 12 may include metal rings or rubber gaskets to form a fluid tight seal between the bottom support 22 and interior of the body 12. The bottom support 22 is adapted to rotate about a bottom edge of the body 12. The bottom support 22 may be adapted to rotate in a clockwise direction, a counter-clockwise direction, or in both a clockwise and counter-clockwise direction. The stem 28 is fixed to the bottom support 22 of the plunger assembly 16, extends parallel to the elongate axis of the container 10. The stem 28 includes a plurality of external screw threads 32. The stem 28 may be integrally formed with the bottom support 22 or separately formed and fixed to the bottom support 22 with a fastener; an adhesive; or welding, for example. The stem 28 extends upwardly through the interior of the container 10 and typically terminates adjacent the finish 20. The plunger 30 is disposed in the interior of the container 10 and a peripheral edge 36 thereof frictionally engages the interior wall of the body 12. The plunger 30 includes an internally threaded aperture 34 adapted to receive the threads 32 of the stem 28. The plunger 30 may be formed from an elastomeric material such as a plastic, for example.

In use, the plunger 30 of the plunger assembly 16 is disposed at the bottom of the container 10 adjacent the bottom support 22 of the plunger assembly 16. As the contents of the container 10 are removed, the user rotates the bottom support 22 of the plunger assembly 16. As the bottom support 22 is rotated, the threads of the plunger 30 cooperate with the threads 32 of the stem 28 to raise the plunger 30 upwardly along the stem 28 of the container 10, thereby adjusting the portion of volume of the container 10 holding the contents, and forcing the contents of the container 10 upwardly towards the top thereof. The frictional force between the plunger 30 and the interior wall of the body 12 militate against the free rotation of the plunger 30 about the stem 28. It is understood that the interior wall of the body 12 may include tabs or other protuberances to militate against the free rotation of the plunger 30.

As the bottom support 22 is rotated and the plunger 30 is raised, the peripheral edge 36 of the plunger 30 is deformed by the support 14. Once the peripheral edge 36 of the plunger 30 is raised past the support 14, the peripheral edge 36 reforms to its original configuration. The plunger 30 is then disposed between adjacent supports 14. A bottom of the plunger 30 is supported by a support 14, thereby militating against a downward movement of the plunger 30. Between the adjacent supports 14, the plunger 30 may be reciprocally moved upward and downward by rotation of the bottom support 22. It is understood that the plunger assembly 16 may include a ratchet means to adjust plunger assembly 16 of the container 10. Alternatively, the plunger assembly 16 may include a stem 28 and a plunger 30 adapted to be manually forced upwardly by the user to adjust the portion of the volume of the container 10 holding the contents thereof. When the container 10 is empty, the user may dispose of the container 10 or clean the container 10 for future use.

The container 10 of the present invention affords several significant benefits and advantages to users thereof. Foremost, the container 10 provides a food preservation container allowing users to easily and expediently retrieve food from the bottom thereof without getting food residue on the hand or the user or a utensil used for food retrieval. In addition, the container 10 prevents the unnecessary waste of food discarded because it is at the bottom of the container 10.

Figure 3:
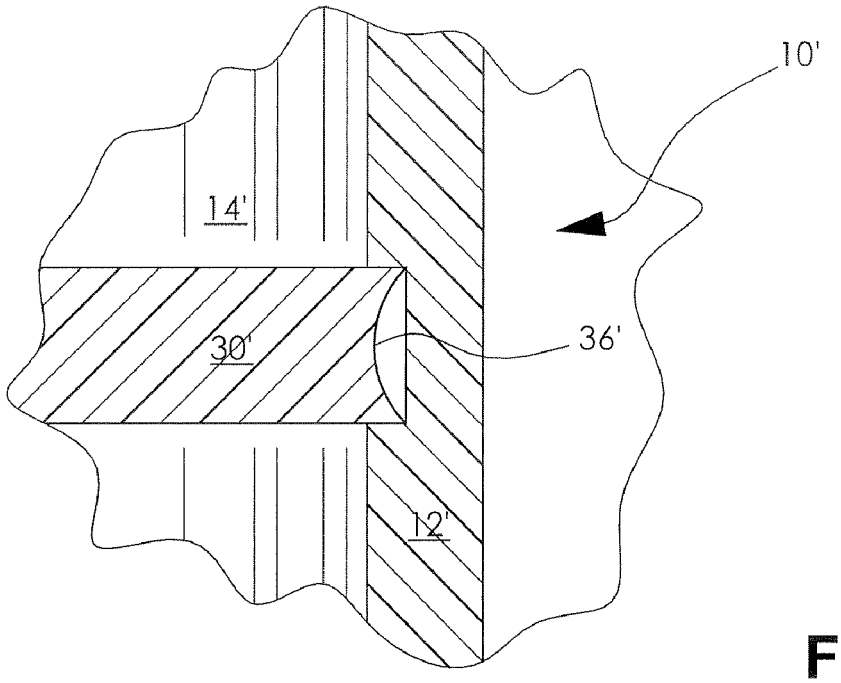
FIG. 3 is an enlarged fragmentary elevational view of a support of a container according to another embodiment of the invention.

FIG. 3 partially shows a container 10' according to another embodiment of the invention. The embodiment of FIG. 3 is similar to the container 10 of FIGS. 1-2 except as described below. Like the structure from FIGS. 1-2, FIG. 3 includes identical reference numerals accompanied by a prime (') symbol.

In the embodiment shown in FIG. 3, the support 14' is an annular channel having a rectilinear cross-section. The channel is formed in an interior of a body 12' of the container 10'. A plurality of annular channels is formed at desired heights in the interior of the body 12'. It is understood that the channel may have any cross-sectional shape, such as triangular and curvilinear, as desired. It is also understood that the support 14' may be an array of channels formed in the interior wall of the body 12' at various heights thereof.

In use, a plunger 30' of a plunger assembly of the container 10' is disposed at the bottom of the container 10' adjacent a bottom of the plunger assembly. As the contents of the container 10' are removed, the user rotates the bottom of the plunger assembly. As the bottom is rotated, the threads of the plunger 30' cooperate with threads of a stem of the plunger assembly to raise the plunger 30' upwardly along an elongate axis of the container 10', thereby adjusting the portion of the volume of the container 10' holding the contents thereof, and forcing the contents of the container 10' upwardly towards the top thereof. A frictional force between the plunger 30' and the interior wall of the body 12' deform a peripheral edge 36' of the plunger 30' militate against the free rotation of the plunger 30' about the stem. It is understood that the interior wall of the body 12' may include tabs or other protuberances to militate against the free rotation of the plunger 30'.

As the bottom is rotated and the plunger 30' is raised, the peripheral edge 36' of the plunger 30' expands to fill the channel of the support 14'. The plunger 30' is then disposed between adjacent supports 14'. A bottom of the plunger 30' is supported by a bottom of the channel of support 14', thereby militating against a downward movement of the plunger 30'. It is understood that the plunger assembly may include a ratchet means to adjust the plunger assembly of the container 10'. Alternatively, the plunger assembly may include only a stem and a plunger 30' adapted to be manually forced upwardly by the user to adjust the portion of the volume of the container 10' holding the contents thereof. When the container 10' is empty, the user may dispose of the container 10' or clean the container 10' for future use.

The container 10' of the present invention affords several significant benefits and advantages to users thereof. Foremost, the container 10' provides a food preservation container allowing users to easily and expediently retrieve food from the bottom thereof without getting food residue on the hand or the user or a utensil used for food retrieval. In addition, the container 10' prevents the unnecessary waste of food discarded because it is at the bottom of the container 10'.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims except as precluded by the prior art. Moreover, the invention as disclosed herein, may be suitably practiced in the absence of the specific elements which are disclosed herein.

What is claimed is:

1. A container having a hollow interior defined by a wall and at least one closed end, including:

a plunger mounted within the interior of the container for reciprocal movement toward and away from the closed end, the plunger having a threaded opening, and an outer peripheral edge adjacent an inner side of the wall, wherein a surface of the outer peripheral edge of the plunger is concave and facilitates an elastic deformation of the outer peripheral edge against the inner side of the wall;

a threaded shank mounted within the interior of the container and cooperates with the threaded opening of said plunger, wherein said plunger frictionally engages the inner side of the wall to militate against the free rotation of said plunger about said shank;

a manually operated member attached to the threaded shank to affect rotary motion of the shank relative to the plunger whereby rotary motion of the member causes linear movement of the plunger within the interior of the container; and a support formed on the inner side of the wall, wherein said plunger and said support cooperate to militate against movement of said plunger toward the closed end.

2. The container of claim 1, wherein said support includes a protuberance.

3. The container of claim 2, wherein said support includes a plurality of protuberances arranged in an annular array.

4. The container of claim 2, wherein the protuberance includes an annular shoulder.

5. The container of claim 2, wherein the protuberance has a triangular cross-section.

6. The container of claim 1, wherein said support is an annular channel formed in the inner side of the wall of the container.

7. The container of claim 1, wherein said shank is fixed to a bottom support.

8. The container of claim 1, wherein the wall includes a finish adapted to receive a closure.

9. The container of claim 6, further including a plurality of spaced apart annular channels formed in the inner side of the wall.

10. The container of claim 1, wherein the plunger is disc shaped.

* * * * *